US005718371A

United States Patent [19]

Smith et al.

[11] Patent Number: 5,718,371

[45] Date of Patent: Feb. 17, 1998

[54] FLIP STYLE CLOSURE

[75] Inventors: Robert J. Smith, Edinboro; Matthew E. Stebick, Waterford; Marty L. Shampoe, Edinboro, all of Pa.

[73] Assignee: Erie County Plastics Corporation, Corry, Pa.

[21] Appl. No.: 548,049

[22] Filed: Oct. 25, 1995

[51] Int. Cl.[6] ..... B65D 43/00

[52] U.S. Cl. ..... 229/125.15; 222/528; 222/541.5

[58] Field of Search ..... 229/125.15; 222/527, 222/528, 529, 530, 531, 534, 535, 541.5

[56] References Cited

U.S. PATENT DOCUMENTS

| | | | |
|---|---|---|---|
| 1,091,761 | 3/1914 | Percy . | |
| 1,698,338 | 1/1929 | Lewin . | |
| 2,086,642 | 7/1937 | Rosenthal . | |
| 2,288,042 | 6/1942 | Spilman . | |
| 2,546,052 | 3/1951 | Wilkins . | |
| 2,742,220 | 4/1956 | Lynes . | |
| 2,757,830 | 8/1956 | Hansen | 222/528 |
| 3,154,226 | 10/1964 | Petitto . | |
| 3,250,436 | 5/1966 | Kurtz | 222/528 |
| 3,896,979 | 7/1975 | Pehr . | |
| 5,014,888 | 5/1991 | Bryan | 222/541 |

*Primary Examiner*—Stephen Cronin

*Attorney, Agent, or Firm*—Michael I. Shamos; Webb, Ziesenheim, Bruening, Logsdon, Orkin & Hanson, P.C.

[57] ABSTRACT

The present invention discloses various one piece, flip style, injection molded, pour spout type closures. Each closure includes a frame having an aperture therethrough with a door hinged along a bottom edge of the aperture for opening and closing the aperture. Side panels are attached to the door and extend between the door and the side edges of the panel to form the pour spout when the door is in the opened position. Two embodiments of the present invention provide hinged side panels which fold up to help seal the closure and provide a substantially flat panel with the door in the closed position. Another embodiment of the present invention provides fixed side panels adapted to extend through the aperture and including stop members to limit the outward movement of the door to the fully opened position.

20 Claims, 6 Drawing Sheets

FLIP STYLE CLOSURE

BACKGROUND OF THE INVENTION

1. Field of the Invention

The present invention relates to a pour spout for a container, more specifically, the present invention relates to a one piece, flip style, injection molded, pour spout type closure.

2. Description of the Prior Art

Collapsible pour spout type closures have long been used for liquid or granulated material holding containers. U.S. Pat. No. 1,091,761 to Percy; U.S. Pat. No. 1,698,338 to Lewin; and U.S. Pat. No. 2,288,042 to Spilman disclose various early designs for cardboard or paper type collapsible closures. U.S. Pat. No. 2,086,642 to Rosenthal; U.S. Pat. No. 2,546,052 to Wilkins; and U.S. Pat. No. 2,742,220 to Lynes also disclose various collapsible closure designs. U.S. Pat. No. 3,154,226 to Petitto and U.S. Pat. No. 3,896,979 to Pehr disclose collapsible plastic pour spout closures.

These patents are representative of the prior art and illustrate the difficulties of the prior art designs. Specifically, many of the prior art designs are intended to be formed of paper or cardboard and consequently have a configuration not easily adapted for injection molding. Furthermore, paper and cardboard pour spouts are less durable than plastic pour spouts and may be considered unacceptable or impractical for certain types of products. The plastic pour spouts of the prior art include different deficiencies. The pour spout disclosed in the '226 patent does not easily collapse to a closed position. The '226 patent requires an additional lid for sealing of the closure. The dispensing spout of the '979 patent is a complicated design which eliminates some of the advantages of foldable side panels. Specifically, the various embodiments disclosed in the '979 patent include elements which project significantly into the interior of the container when the closure is in the closed position. This design can interfere with the material in the container. It is advantageous to have a closure which is closed into a substantially flat panel shape so as not to interfere with the material in the interior of the container.

With certain types of containers, the consuming public is far more concerned with material, such as insects and the like, entering into the container rather than material escaping from the container. Many of the prior art structures do not adequately seal the closure in the closed condition. This limitation is particularly true in the injection molded closures of the prior art. Further, it is important for the user of a closure to be able to easily determine when the closure is in the closed or sealed position. The prior art closures do not all provide mechanisms which easily indicate to the user when the closure has sealed.

With regard to injection molded closures which are manufactured separate from the container, consideration should also be given to the manufacturing process of the container and the subsequent attachment of the closure to that container. The prior art of record does not address the container manufacturing requirements in the various closure designs.

It is the object of the present invention to overcome the aforementioned drawbacks of the prior art. It is a further object of the present invention to provide a one piece, collapsible, injection molded closure which is easily manufactured and assembled onto the container. A further object of the present invention is to provide an injection molded closure which minimizes the possibility of material entering into or escaping from the container when in the closed position. A further object of the present invention is to provide a closure which clearly indicates to the user when the closure is moved to the fully closed and sealed position.

SUMMARY OF THE INVENTION

The objects of the present invention are achieved by a one piece, collapsible, injection molded closure. The flip style closure according to the present invention includes a frame with an aperture therethrough. The aperture has a top edge, a bottom edge and a pair of opposed side edges within the frame. A door is hinged to the frame along the bottom edge of the aperture for opening and closing of the aperture. A first set of an even number of hinged side panels is attached to and extends between one of the side edges of the aperture and a first side of the door. A second set of an even number of side panels is attached to and extends between the other side edge of the side panel and an opposed side of the door.

A first side panel of the first and second set of the side panels has a side edge attached to a respective side edge of the aperture and an opposed side edge of each first side panel attached to an adjacent side panel. A top edge of each first side panel has a shape substantially the same as the portion of the top of the aperture.

The top edges of both first side panels may combine to form substantially the entire shape and length of the top of the aperture with the top edges of both first side panels positioned substantially adjacent and aligned with the top of the aperture when the door is in a closed position.

Each of the plurality of side panels may be formed as a wedge shaped side panel defining a given angle between the side edges thereof whereby there is a given relationship between the width of the aperture, the height of the aperture and the angle of each side panel. The present invention may additionally include substantially identical side panels whereby the door forms a specific angle with the frame when the door is in a fully opened position such that there is a specific relationship between the width and height of the aperture, the angle between the frame and the door in the opened position and the number of side panels.

The present invention may include an offset position in the frame along the bottom edge of the aperture to which the door is hinged with the offset allowing for the closing of the door without deformation of the frame.

The present invention may provide a closure indicating feedback mechanism. Specifically, the aperture, the side panels and the door may be shaped with very tight or slightly overlapping tolerances such that an audible click is produced when the door is moved into the closed position. The audible click will provide a tactile and audible signal to the user that the closure has been moved to the closed and sealed position.

The present invention may provide that the door overlaps a portion of the frame adjacent the top edge of the aperture with the door in the closed position. Additionally, the present invention may provide that a second side panel of each set of side panels overlaps a portion of the frame adjacent the top edge of the aperture with the door in the closed position. The overlapping arrangement of the door and/or second side panels provides for a labyrinth type seal preventing intrusion of material, such as infestation by insects and the like, into the interior of the container. The seal also prevents material escaping from the container.

The present invention may further include a triangle shaped depression in a top surface of the door. The triangle shaped depression provides for an orientation mechanism to assist in manufacturing of the container which includes the closure.

Another embodiment of the present invention provides a one piece injection molded closure formed of a substantially rectangular frame with an aperture therethrough. The frame includes an upper frame member positioned along two side edges and a top edge of the aperture. A bottom frame member is positioned along a bottom edge of the aperture and is hinged to the upper frame member with the bottom frame member adapted to move between a molded position at an operative position parallel with the upper frame member. A door is hinged to the bottom frame member along the bottom edge of the aperture for opening and closing of the aperture. A pair of fixed, spaced, wedge shaped side panels are attached to the door and positioned substantially perpendicular thereto. The pair of side panels are adapted to extend through the aperture adjacent the side edges of the aperture and orientated substantially perpendicular to the upper frame member. The closure may provide each side panel with a stop extending from the side of the top edge of each side panel opposite from the door. The stop is adapted to abut against an inside of the upper frame member when the door is in the fully opened position. This embodiment of the present invention provides a simple, moldable construction for a closure type which does not require a flat planar construction when in the closed position.

These and other objects of the present invention will be clarified in the description of the preferred embodiments together with the attached figures wherein like reference numerals represent like elements throughout.

BRIEF DESCRIPTION OF THE PREFERRED EMBODIMENTS

FIGS. 1–9 illustrate a one piece, injection molded, collapsible pour spout type closure 10 according to a first embodiment of the present invention. As is well-known in the injection molding industry, the design of an injection molded part introduces certain restrictions in the design which can be significant in complex structures. Without appropriate care to design considerations, a particular piece may be impossible, or completely impractical, to economically mold by injection molding. The closure 10 of the present invention has been designed with these restraints in mind and provides an effective closure 10 which can be economically injection molded.

The closure 10 of the present invention may be made of any appropriate size sufficient for the intended operation. However, in general, the closure 10 will be about 2 inches high and 2 inches wide. As will be discussed hereinafter, the closure 10 is designed such that in the fully closed position, the closure 10 has a thickness of less than 1/10 inch. The specific thickness of the closure 10 in the closed position will, of course, depend upon the thickness chosen for the manufacture of the individual components.

Figure 5:
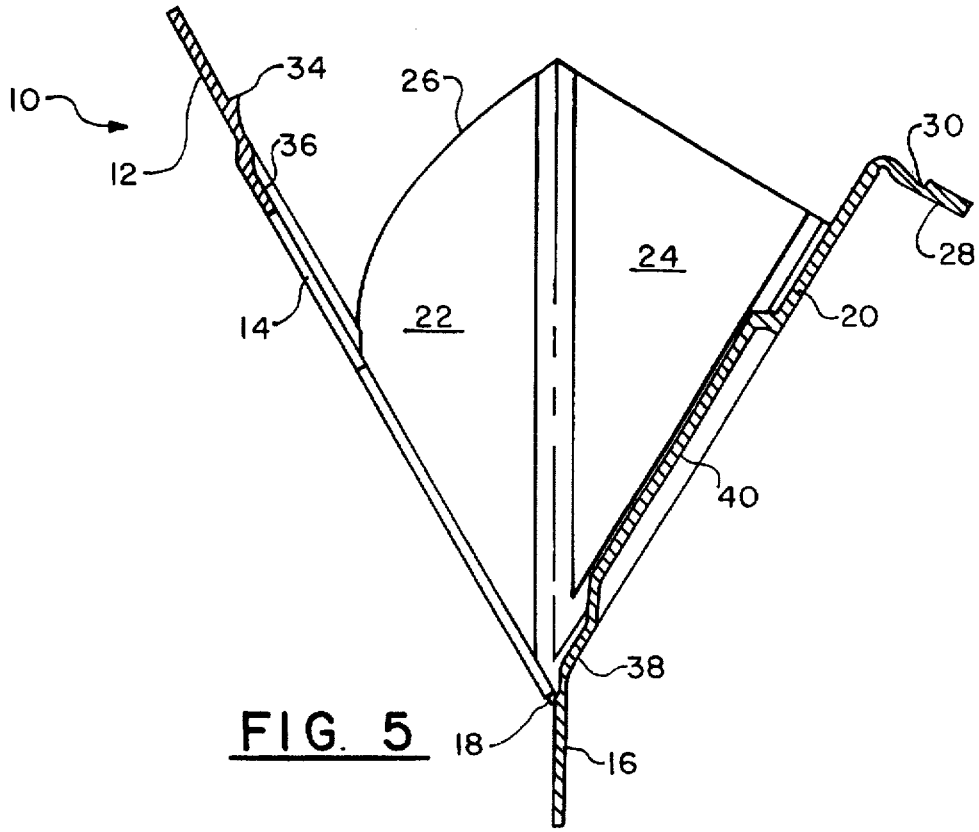
FIG. 5 is a cross sectional side view of the closure illustrated in FIG. 1 with the closure in an as-molded position.
Figure 6:
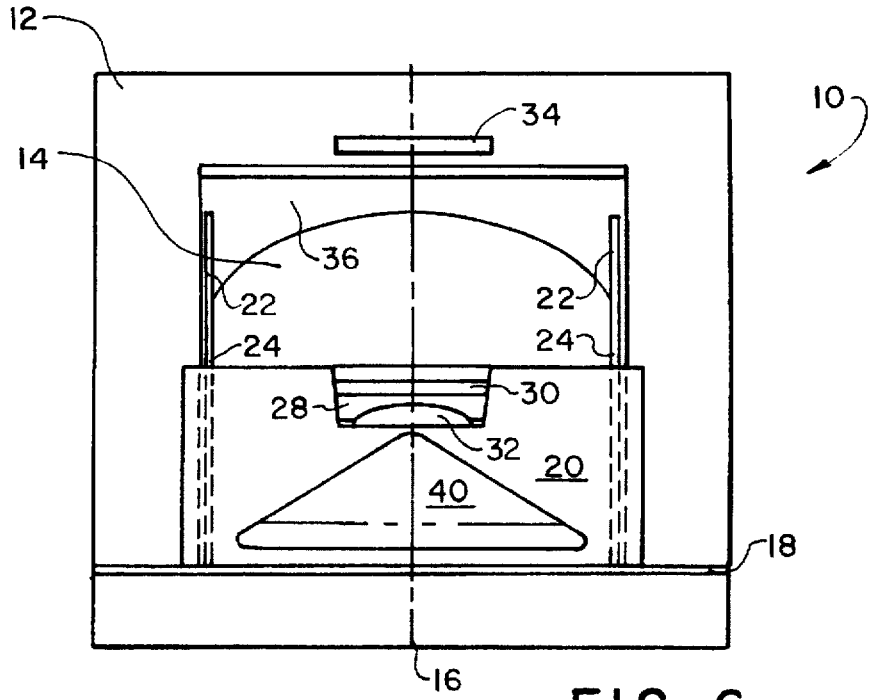
FIG. 6 is a front view of a closure illustrated in FIG. 1 with the closure in an as-molded position.
Figure 7:
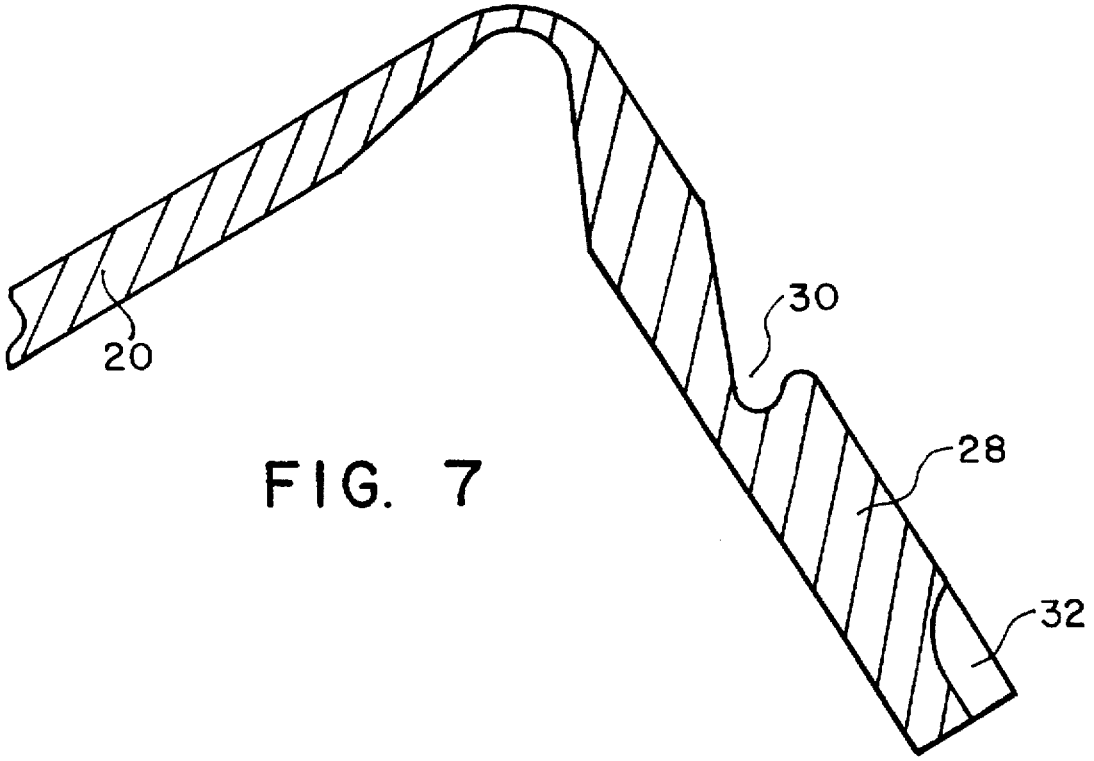
FIG. 7 is an enlarged sectional view of the latch of the closure illustrated in FIG. 1 with the latch in the opened position.

The closure 10 includes a substantially rectangular frame 12 with an aperture 14 therethrough. The frame 12 is substantially rectangular in shape with an upper frame member positioned along two side edges and a top edge of the aperture 14. A bottom frame member 16 extends along a bottom edge of the aperture 14 and is hinged to the upper frame member at hinge 18. As shown in FIGS. 5 and 6, the hinge 18 allows the bottom frame member 16 to be molded in a position angled away from the upper portion of the frame 12 and subsequently pivoted into a position aligned with the remaining portions of the frame 12. This construction is important for developing an easily moldable closure 10.

Figure 1:
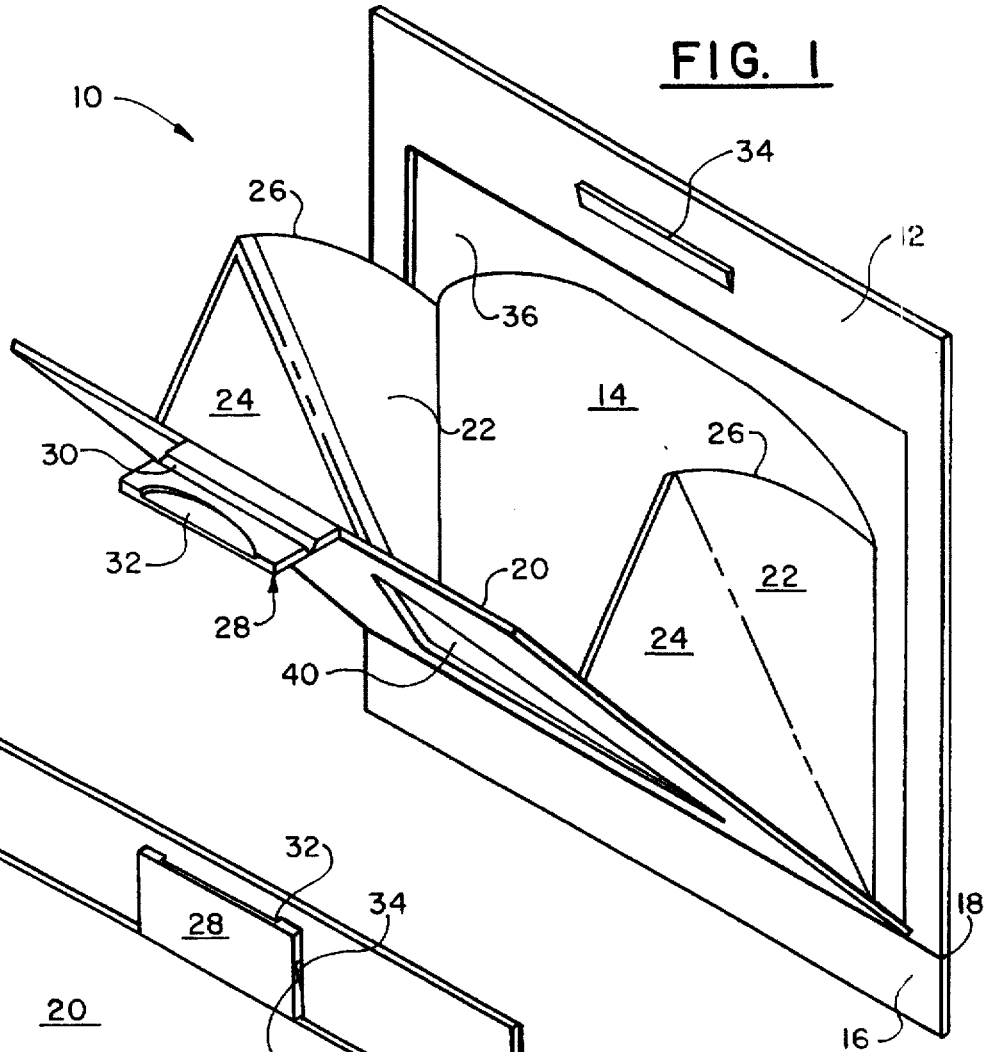
FIG. 1 is a perspective view of a closure according to a first embodiment of the present invention with the closure in the fully opened position.
Figure 4:
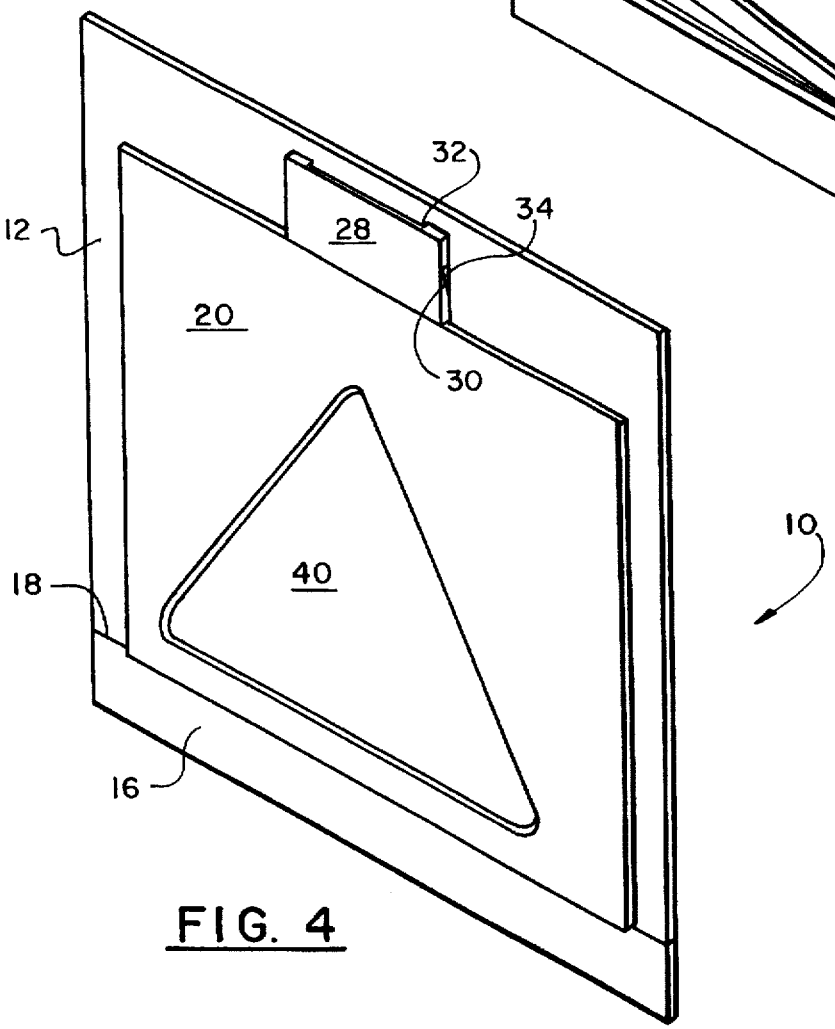
FIG. 4 is a perspective view of the closure illustrated in FIG. 1 with a closure in a completely closed position.
Figure 2:
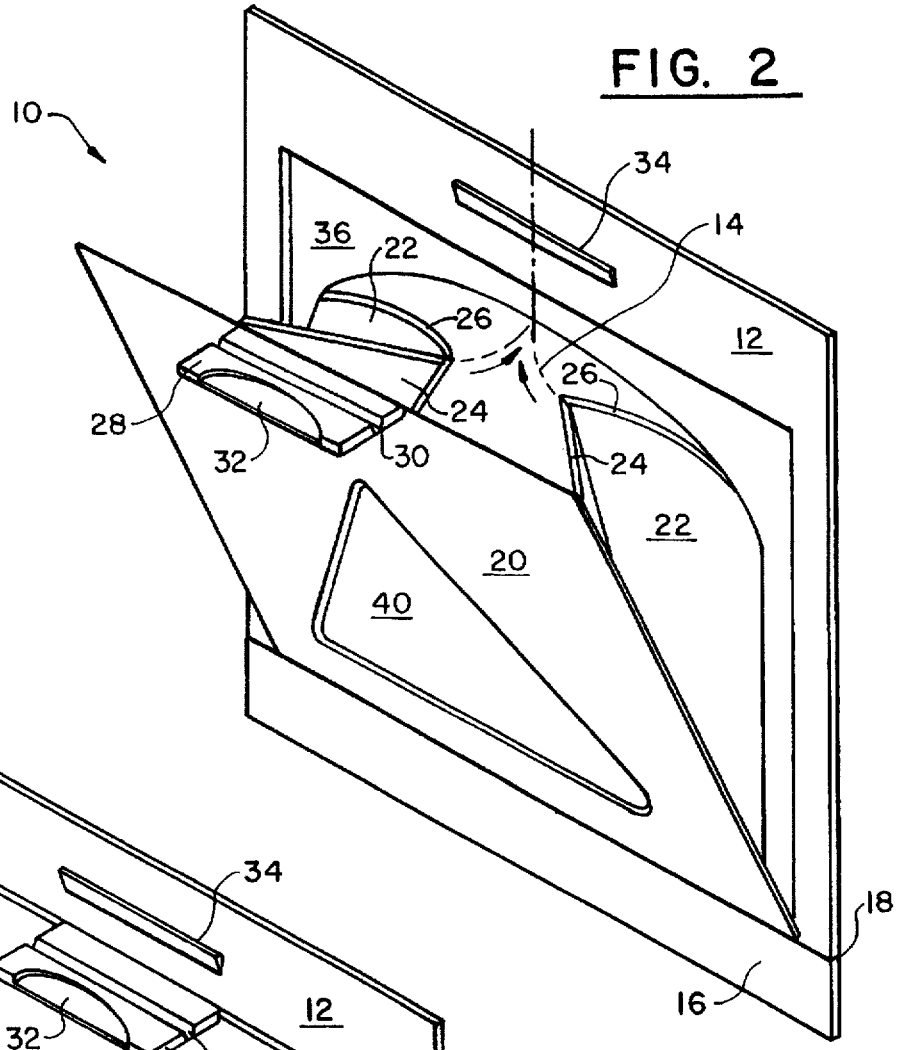
FIG. 2 is a perspective view of the closure illustrated in FIG. 1 with the closure in a partially closed position.
Figure 3:
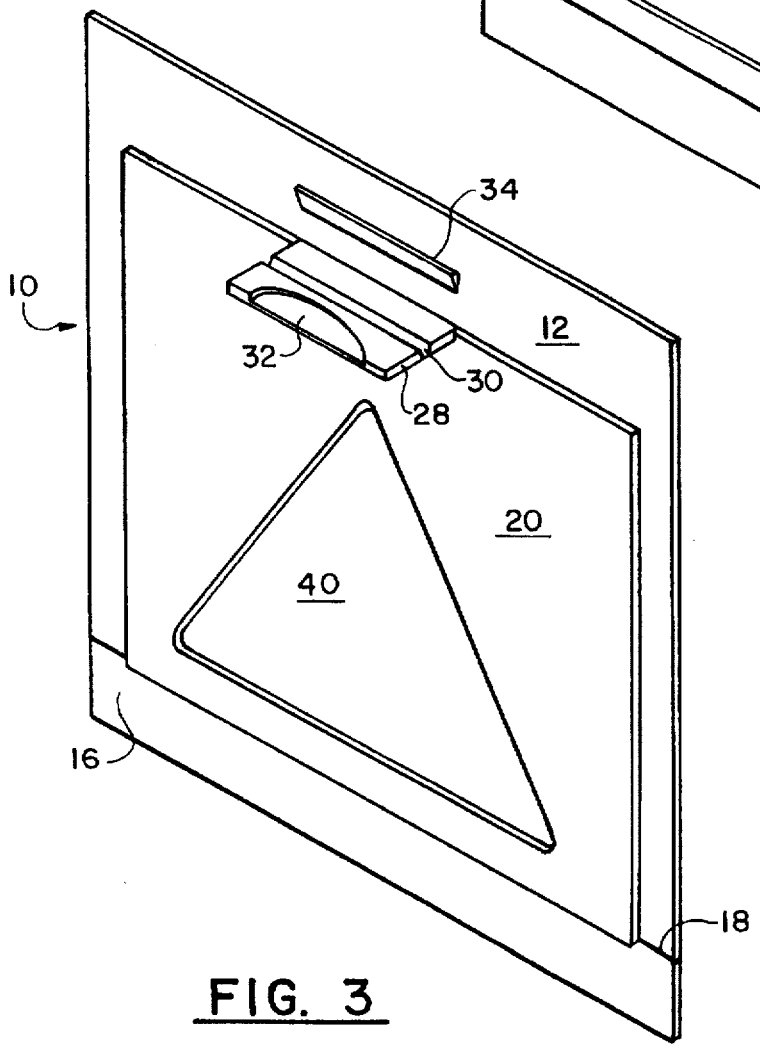
FIG. 3 is a perspective view of the closure illustrated in FIG. 1 with the closure in a closed position with a latch opened.

A substantially rectangular door 20 is hinged to the frame 12 along the bottom edge of the aperture 14 for opening and closing of the aperture 14. As shown in FIGS. 3 and 4, the door 20 is larger than the aperture 14. A pair of wedge shaped side panels 22 and 24 are attached to and extend between each of the side edges of the aperture 14 and respective sides of the door 20. The first side panel 22 of each set of side panels is hinged to the frame 12 at the side edge of the aperture 14. An opposed edge of each first side panel 22 is hinged to an adjacent, second side panel 24. Each second side panel 24 is also hinged to a respective side of the door 20. A top edge 26 of each first side panel 22 is shaped essentially identical to the shape of one-half of the top edge of the aperture 14. As best illustrated in FIG. 2, when the door 20 is moved to the closed position, the top edges 26 of both first side panels 22 will matingly abut against and align with the top edge of the aperture 14. The top edges 26 of both first side panels 22 combine to form the shape of the entire top edge of the aperture 14 with each side panel 22 extending half way across the aperture 14.

The side edges of the aperture 14 are substantially parallel to each other and substantially perpendicular to the bottom edge of the aperture 14. With the first side panels 22 having an angle θ formed between the side edges thereof in the closure 10 according to the present invention, the following relationship will be satisfied:

$$W=2\cdot H\cdot \text{Tan}\ \theta,$$

where W is the width of the aperture measured perpendicular to the side edges of the aperture 14 measured adjacent the top of the aperture 14 and H is the height of the aperture 14 measured parallel to the side edges of the aperture 14 and measured midway along the width of the aperture 14 at a position where the two first side panels 22 will converge with the door 20 in the closed position. This construction will help seal the closure 10 with a door 20 in the closed position.

Each second side panel 24 is a wedge shaped panel having the same angle θ between the side edges thereof as each first side panel 22. A top edge of each side panel 24 is a straight edge extending between the top edge of the first side panel 22 and the door 20 and is substantially perpendicular to the plane of the door 20 as shown in FIG. 6. As best illustrated in FIG. 2, this construction results in a partial overlap of the side panels 24 over aperture 14 and the frame 12 when the door 20 is in the closed position creating a labyrinth type seal further securing the closure. The door 20 also overlaps the aperture 14 and the frame 12 when the door 20 is in the closed position as illustrated in FIGS. 3 and 4 to provide additional sealing protection.

Figure 8:
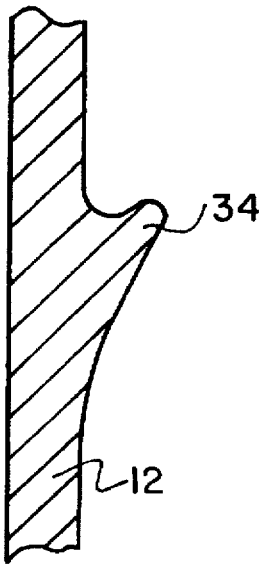
FIG. 8 is an enlarged sectional view of a latch connector of the closure illustrated in FIG. 1.

The door 20 includes a latch 28 hinged to an upper end thereof for opening and closing the door 20. The latch 28 includes a locking recess 30 and thumb grip 32. The frame 12 includes a corresponding latch connecting ridge 34, which is best illustrated in FIG. 8, which engages the locking recess 30 to hold the latch 28 in a closed position as shown in FIG. 4. The latch 28 may be utilized in a conventional fashion to open and close the door 20 and therefore the closure 10.

Figure 9:
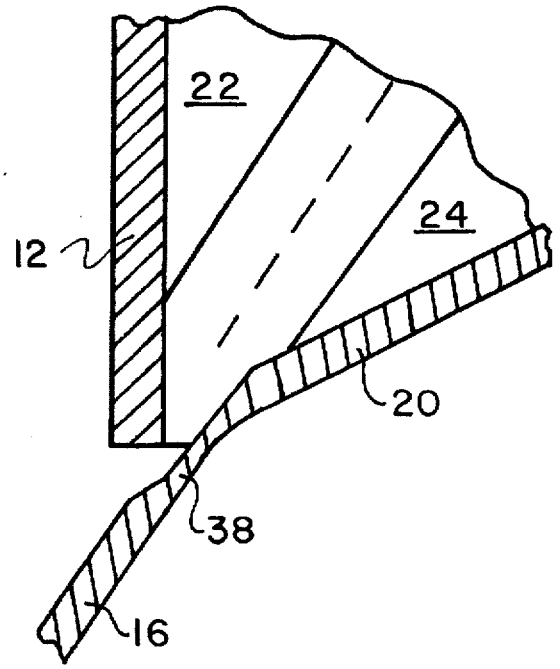
FIG. 9 is an enlarged sectional view of a portion of the closure illustrated in FIG. 1.

The upper portion of the frame 12 includes a recessed portion 36 which includes the top edge and the side edges of the aperture 14 therein. The position of the recess portion 36 allows for the closure 10 to maintain a minimum thickness when in the closed position. Additionally, as shown in FIG. 9, the frame 12 includes an offset 38 to which the door 20 is hinged. The offset 38 is provided to accommodate the thickness of the side panels 22 and 24 when the door 20 is in the closed position without creating inappropriate distortions in the frame 12.

The aperture 14, the side panels 22 and possibly the door 20 are shaped with very tight or slightly overlapping tolerances such that an audible click is produced when the door 20 is moved into the closed position. The closure of the latch 28 may additionally provide an audible click to provide the feedback to the user when closing these elements. The provision of an audible click is deemed particularly important by consumers who are concerned about whether a closure has achieved the completely closed and sealed position.

The side panels 22 and 24 have identical angles θ and the aperture 14 has a width W and height H as described above. Additionally, the top edges of both first side panels 22 abut against the entire top edge of the aperture 14 when the door 20 is in the closed position as discussed above. An angle α is formed between the frame 12 and the door 20 in its fully opened position. In the closure 10 according to the present invention, a unique quantifiable relationship exists between the door opening angle e and the width W and height H of the opening. This relationship is as follows:

$$W=2\cdot H\cdot \mathrm{Tan}\,(\alpha/2).$$

As illustrated hereinafter in connection with FIGS. 10 and 11, additional numbers of side panels can be provided with each set of side panels. However, it is required that an even number of side panels is provided for each set to allow the closure 10 to close to a substantially flat panel shape. The provision of an uneven number of side panels for either side will result in elements extending into or through the aperture with the door 20 in the closed position and prevent the closure 10 from obtaining a substantially planar configuration in a closed position. With an even number of identically shaped side panels of each set of side panels, the relationship between the angle α and the width W and height H of the aperture 14 according to the present invention can be generalized as follows:

$$W=2\cdot H\cdot \mathrm{Tan}\,(\alpha/N),$$

where N is the number of side panels on each side of the aperture.

The door 20 additionally includes a triangular shaped depression 40 provided in a top surface thereof. The depression 40 is positioned to substantially align with the side panels 24 with the door 20 in the closed position such that the depression 40 will be adjacent the side edges of the side panel 24 with the door 20 in the closed position. The triangular depression 40 provides for a visual indication of the orientation of the closure 10. Additionally, the depression 40 is particularly well suited for use in the manufacturing of the associated container. The triangular shaped depression 40 provides for a mechanism for locating and orientating the closure 10 in an automated assembling process for a proper attachment on the associated container. Prior art structures have generally required a greater degree of operator intervention during the attachment of a closure to a container to assure proper orientation and placement of each closure. Conventional assembly line machinery can utilize the depression 40 for proper location, movement, orientation, and positioning of the closure 10. Additionally assisting in the manufacturing steps is the maintaining of the closure 10 as a substantially flat panel with a door 20 in the closed position.

Figure 10:
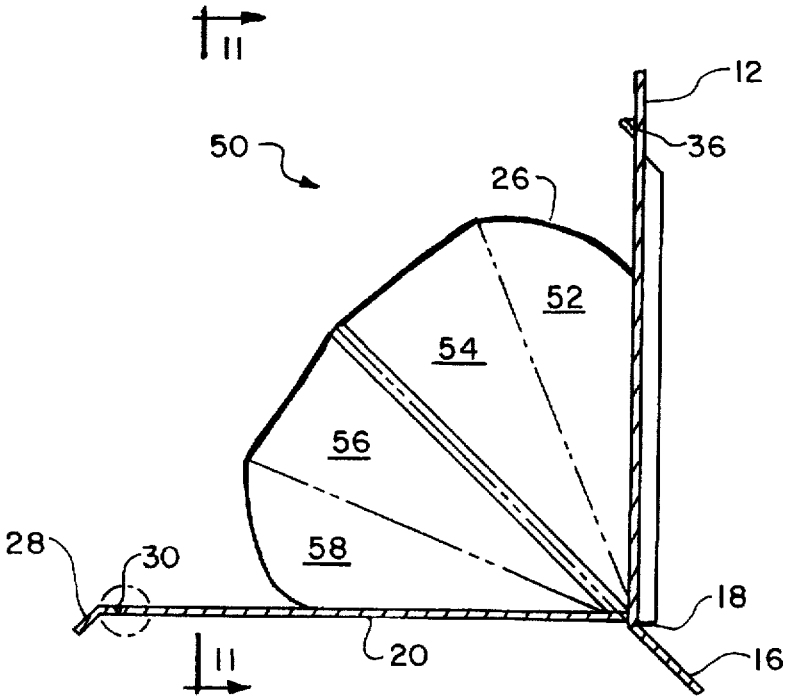
FIG. 10 is a sectional side view of a closure according to a second embodiment of the present invention.
Figure 11:
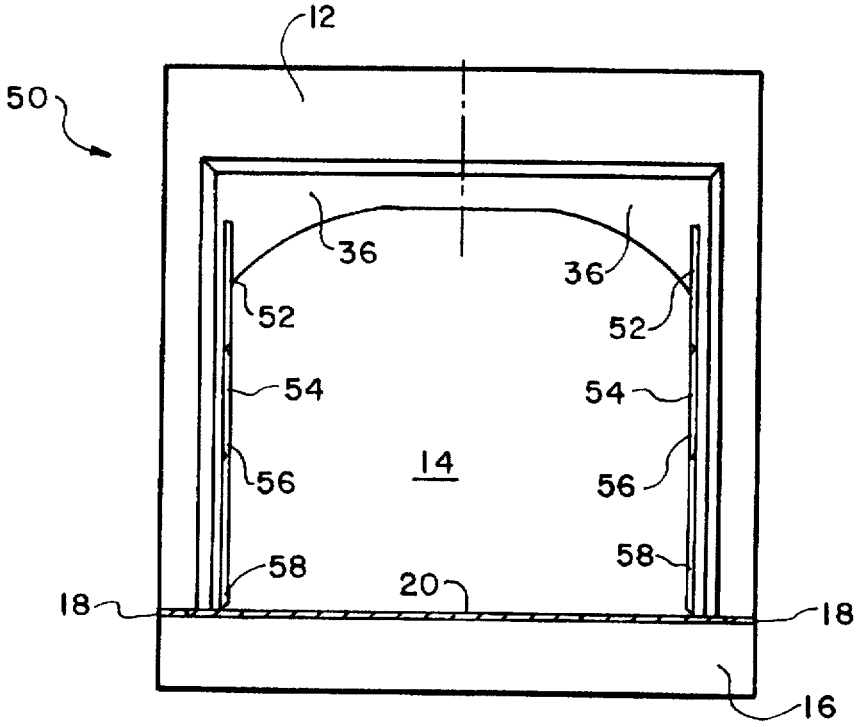
FIG. 11 is a front view of the closure illustrated in FIG. 10.

FIGS. 10 and 11 illustrate a closure 50 according to a second embodiment of the present invention. The closure 50 is substantially identical to the closure 10 discussed above except that four side panels 52, 54, 56 and 58 are provided for each set of side panels on each side of the door 20 and aperture 14. The first side panels 52 operate substantially the same as discussed above in connection with first side panels 22. The first side panels 52 have a top edge thereof which corresponds to one-half of the top edge of the aperture 14. As shown in the drawings, side panels 54 and 56 will overlap the frame 12 as will the door 20 with the door 20 in the closed position to provide for better sealing of the closure 50. In both the closure 10 and the closure 50, the alignment of the first side panels 22 and 52 with the upper edge of the aperture 14 and the overlapping of the subsequent side panels 54, 56 and 24, respectively, and the door 20 with the aperture 14 and the frame 12 all act to increase the sealing arrangement of the resulting closure 10 and 50. This sealing construction is highly viable and will give greater confidence to the ultimate consumer that the integrity of the closure is not compromised.

Figure 12:
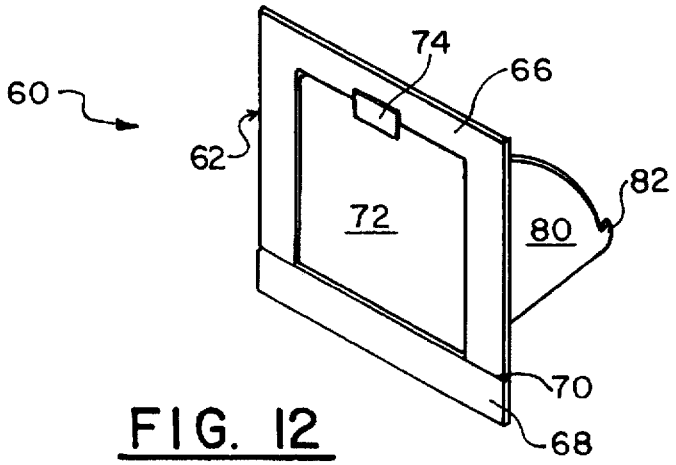
FIG. 12 is a perspective view of a closure illustrated in the closed position according to a third embodiment of the present invention.
Figure 13:
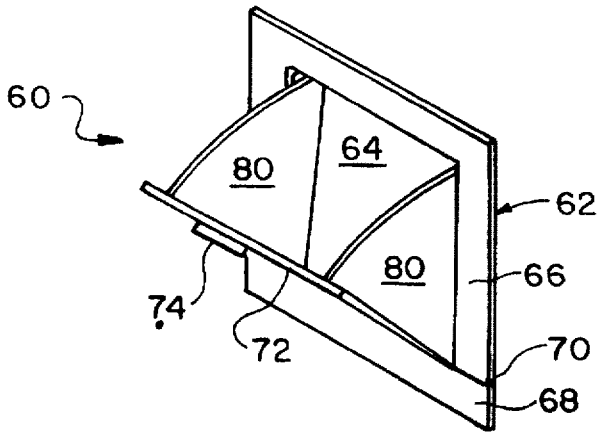
FIG. 13 is a perspective view of the closure illustrated in FIG. 12 with the closure in an opened position.

FIGS. 12 and 13 illustrate a closure 60 according to a third embodiment of the invention. The closure 60 is designed for containers where flat panel closures are not required. The closure 60 includes a frame 62 with an aperture 64 extending therethrough. The frame 62 is formed of an upper frame member 66 and lower frame member 68 hinged to the upper frame member by hinge 70. As shown in FIG. 13, the provision of the hinge 70 allows for the economical molding of the closure 60 in a position shown in FIG. 13. The lower frame member 68 is adapted to be moved from the molded position shown in FIG. 13 to the operative position shown in FIGS. 12 and 14, which the lower frame member 68 is aligned with and parallel to the upper frame member 66. A door 72 is hinged to the bottom frame member 68 along a bottom edge of the aperture for opening and closing the aperture 64. The door 72 includes a latch 74 at an upper end thereof for opening and closing the door 72. As discussed above, the closure 60 is not designed to provide a minimum thickness flat panel when in the closed position. Consequently, the frame 62 may be provided sufficiently thick to include locking recesses 76 and the sides thereof which receive engaging nubs 78 provided on the side of the door 72. Alternatively, the latch 74 can be constructed similar to the latch 28 discussed above in connection with closure 10.

Figure 14:
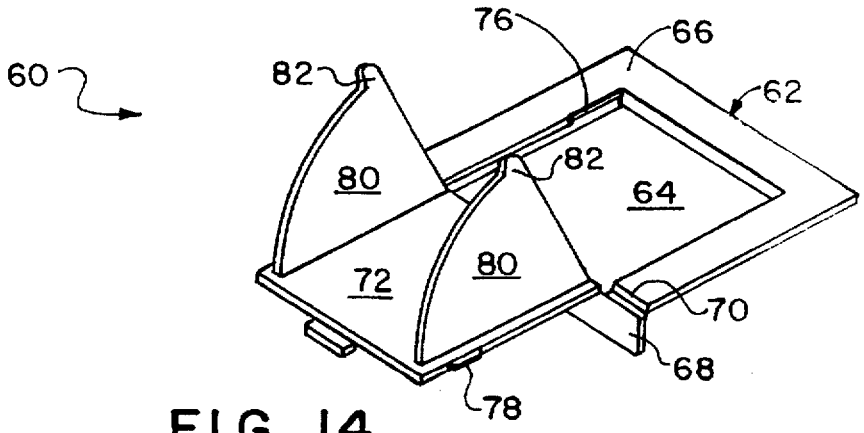
FIG. 14 is a perspective view of the closure illustrated in FIG. 12 with the closure in an as-molded position.

A pair of fixed, spaced wedge shaped side panels 80 are attached to the door 72 substantially perpendicular thereto. The side panels 80 further include a stop extending from a side of a top edge which is opposite from the door 72. The stop 82 is adapted to abut against an inside of the frame 62 when the door 72 is in the fully opened position as illustrated in FIG. 13 or 14. The side panels preferably have a curved upper edge having a radius of curvature equal to the height of the aperture so that the side panels 80 will be maintained close to the top edge of the aperture 64 during opening and closing of the door 72 of the closure 60. As clearly illustrated in the fully opened position, the side panels 80 and door 72 combine to form a pour spout for the container through the aperture 64. This configuration is true for all of the closures 10, 50 and 60 that the side panels and door combine to form the pour spout for the container which is accessed through the aperture in the frame. Additionally, all of the closures 10, 50 and 60 have been designed to be easily injection molded.

It is apparent from the description of the preferred embodiments that various modifications may be made to the present invention without departing from the spirit and scope thereof. Consequently, the scope of the present invention is defined by the appended claims.

We claim:

1. A one piece injection molded closure comprising:

a continuous frame completely surrounding an aperture therethrough, said aperture having a top edge, a bottom edge, and a pair of opposed side edges;

a door hinged to said frame along said bottom edge of said aperture for opening and closing said aperture;

a first set of an even number of hinged side panels attached to and extending between one of said side edges of said aperture and said door; and a second set of an even number of hinged side panels attached to and extending between the other of said side edges of said aperture and said door;

wherein a first of said side panels of said first and second set includes a side edge attached to said side edge of said aperture, an opposed side edge attached to an adjacent side panel of said set of side panels, and a top edge having a shape substantially the same as a portion of said top edge of said aperture, and wherein each of said side panels is substantially wedge shaped and hinged on opposite sides and wherein said door includes a triangular shaped depression on a top surface thereof.

2. The closure of claim 1 wherein said top edges of said first side panels of said first and second set combine to form substantially the entire shape and length of said top edge of said aperture, and wherein said side edges of said aperture are parallel to each other.

3. The closure of claim 2 wherein the length of each said top edge of said first side panels is substantially equal to one-half the length of said top edge of said aperture.

4. The closure of claim 2 wherein said top edges of said first side panels of said first and second set are positioned adjacent to and aligned with said top edge of said aperture when said door is in a closed position.

5. The closure of claim 1 wherein said first side panel of said first and second set is a wedge shaped side panel having angle θ between side edges thereof which substantially satisfies the following relationship $$W=2\cdot H\cdot \mathrm{Tan}\ \theta$$

where

W is the width of said aperture measured perpendicular to said side edges of said aperture adjacent said top edge of said aperture, and H is the height of said aperture measured parallel to said side edges of said aperture midway along said width of said aperture.

6. The closure of claim 5 wherein each said side panel is substantially identical and said door forms an angle α with said frame when said door is in a fully opened position, wherein said angle α substantially satisfies the following relationship $$W=2\cdot H\cdot \mathrm{Tan}\ (\alpha/N)$$

where N is the number of said side panels in each said set.

7. The closure of claim 1 wherein said depression is adjacent said side edges of at least one said side panel when said door is in said closed position.

8. The closure of claim 1 wherein said door overlaps a portion of said frame adjacent said top edge of said aperture when said door is in said closed position.

9. The closure of claim 1 wherein a second side panel of each set of side panels is hinged to said first side panel and overlaps a portion of said frame adjacent said top edge of said aperture when said door is in said closed position.

10. The closure of claim 1 wherein two said side panels are provided for each said set of side panels, and wherein said side edges of said aperture are parallel to each other.

11. The closure of claim 1 wherein four said side panels are provided for each said set of side panels.

12. The closure of claim 1 wherein said frame includes a recessed portion, said recessed portion including said top edge of said aperture.

13. A one piece, injection molded pour spout type closure comprising:

a frame having an aperture formed therein, said aperture having a bottom edge, a top edge, and a pair of side edges;

a door hinged to said frame along said bottom edge of said aperture for opening and closing said aperture, said door including a triangular recess in a top surface thereof; and an even number of substantially wedge shaped side panels on each side of said aperture attached to and extending between said side edges of said aperture and said door, each said side panel hinged on opposed sides thereof, wherein said closure forms a substantially flat panel with said door in a closed position.

14. The closure of claim 13 wherein two of said side panels which are attached to said side edges of said aperture have top edges which combine to substantially form the entire shape and length of said top edge of said aperture.

15. The closure of claim 14 wherein said aperture, said side panels and said door are shaped such that an audible click is produced as said door is moved to said closed position.

16. The closure of claim 13 wherein each said wedge shaped side panel forms substantially the same angle between opposed side edges thereof, and wherein said side edges of said aperture are parallel to each other.

17. The closure of claim 16 wherein said door forms an angle α with said frame when said door is in a fully opened position, wherein said angle α substantially satisfies the following relationship $$W=2\cdot H\cdot \mathrm{Tan}\ (\alpha/N)$$

where

W is the width of said aperture measured perpendicularly to said side edges of said aperture adjacent said top edge of said aperture, H is the height of said aperture measured parallel to said side edges of said aperture midway along said width of said aperture, and N is the number of said side panels on each side of said aperture.

18. The closure of claim 13 wherein said frame includes an offset along said bottom edge of said aperture to which said door is hinged.

19. A one piece injection molded closure comprising:

a substantially rectangular frame with an aperture therethrough, said frame including an upper frame member positioned along two side edges and a top edge of said aperture, and a bottom frame member along a bottom edge of said aperture, said bottom frame member hinged to said upper frame member, said bottom frame member adapted to move between a molded position and an operative position parallel and aligned with said upper frame member;

a door hinged to said bottom frame member along said bottom edge of said aperture for opening and closing of said aperture; and a pair of spaced wedge shaped side panels attached to said door adapted to be positioned substantially perpendicular thereto when said door is in a fully opened position, wherein said side panels are fixably attached to said door and said pair of spaced side panels are adapted to extend through said aperture adjacent said side edges of said aperture and substantially perpendicular to said upper frame member.

20. The closure of claim 19 wherein each said side panel further includes a stop extending from the side of said top edge opposite from said door, said stop adapted to abut against an inside of said upper frame member when said door is in a fully opened position.

* * * * *